US008820024B1

(12) United States Patent
Abdullah et al.

(10) Patent No.: US 8,820,024 B1
(45) Date of Patent: Sep. 2, 2014

(54) WALL BUILDING SYSTEM AND METHOD

(71) Applicants: Mohammad A. H. S. H. Abdullah, Dasma (KW); Hamad S. H. S. Husain, Dasma (KW)

(72) Inventors: Mohammad A. H. S. H. Abdullah, Dasma (KW); Hamad S. H. S. Husain, Dasma (KW)

( * ) Notice: Subject to any disclaimer, the term of this patent is extended or adjusted under 35 U.S.C. 154(b) by 9 days.

(21) Appl. No.: 13/794,601

(22) Filed: Mar. 11, 2013

(51) Int. Cl.
*E04B 2/08* (2006.01)
*E04B 1/02* (2006.01)
*E04B 1/21* (2006.01)

(52) U.S. Cl.
CPC ..... *E04B 2/08* (2013.01)
USPC ..... 52/605; 52/561; 52/582.1; 52/596

(58) Field of Classification Search
USPC ..... 52/582.1, 586.1, 596, 604, 605, 607, 52/309.7, 404.1, 405.1, 404.4, 426, 561, 52/564, 570; 446/124
See application file for complete search history.

(56) References Cited

U.S. PATENT DOCUMENTS

| | | | | | |
|---|---|---|---|---|---|
| 738,643 | A | * | 9/1903 | Van Camp | 52/284 |
| 1,420,478 | A | * | 6/1922 | Forbush | 52/426 |
| 1,444,422 | A | * | 2/1923 | Meyer | 52/605 |
| 1,785,499 | A | * | 12/1930 | Sayers | 52/505 |
| 1,815,921 | A | * | 7/1931 | Lapof | 250/517.1 |
| 2,087,541 | A | * | 7/1937 | Koester | 52/342 |
| 2,134,941 | A | * | 11/1938 | Guignon, Jr. | 52/582.1 |
| 2,225,612 | A | * | 12/1940 | Allen | 52/586.2 |
| 2,269,018 | A | * | 1/1942 | Guignon, Jr. | 52/308 |
| 2,332,081 | A | * | 10/1943 | Hunt et al. | 52/586.1 |
| 2,684,589 | A | * | 7/1954 | Perreton | 52/591.2 |
| 2,701,959 | A | * | 2/1955 | Briggs | 52/505 |
| 2,736,188 | A | * | 2/1956 | Wilhelm | 52/560 |
| 2,792,704 | A | * | 5/1957 | Kooiman | 52/503 |
| 3,782,049 | A | * | 1/1974 | Sachs | 52/309.9 |
| 4,038,798 | A | * | 8/1977 | Sachs | 52/309.7 |
| 4,075,808 | A | * | 2/1978 | Pearlman | 52/439 |
| 4,229,920 | A | * | 10/1980 | Lount | 52/309.12 |
| 4,295,313 | A | * | 10/1981 | Rassias | 52/438 |
| 4,319,440 | A | * | 3/1982 | Rassias et al. | 52/438 |
| 4,391,077 | A | * | 7/1983 | Giess | 52/748.11 |
| 4,473,985 | A | * | 10/1984 | Hunt | 52/592.6 |
| 4,879,855 | A | * | 11/1989 | Berrenberg | 52/309.11 |
| 5,465,542 | A | * | 11/1995 | Terry | 52/309.7 |
| 5,701,710 | A | * | 12/1997 | Tremelling | 52/426 |
| 5,729,943 | A | | 3/1998 | Cambiuzzi | |
| 5,802,797 | A | * | 9/1998 | Storer-Folt | 52/604 |
| 5,809,728 | A | * | 9/1998 | Tremelling | 52/426 |
| 5,855,102 | A | * | 1/1999 | Chang | 52/604 |
| 5,913,791 | A | * | 6/1999 | Baldwin | 52/612 |
| 5,921,046 | A | * | 7/1999 | Hammond, Jr. | 52/564 |
| 6,000,186 | A | * | 12/1999 | Fielding et al. | 52/564 |

(Continued)

FOREIGN PATENT DOCUMENTS

WO WO 2013088154 A1 * 6/2013

*Primary Examiner* — Basil Katcheves
*Assistant Examiner* — Rodney Mintz
(74) *Attorney, Agent, or Firm* — Richard C Litman

(57) ABSTRACT

The wall building system and method uses a block for building walls and other structures. The block is formed with an external face member and an internal face member connected by an inner core, which has an outer surface formed with a concave profile. The block is fabricated in one piece to enhance strength and stability. Each face is provided with a continuous groove therearound. The continuous grooves are adapted to receive locking elements therein to interlock the blocks. Utilizing a locking element eliminates the need for binding compounds, such as mortar, thereby greatly reducing labor and material costs.

2 Claims, 7 Drawing Sheets

(56) References Cited

U.S. PATENT DOCUMENTS

| | | | | | |
|---|---|---|---|---|---|
| 6,085,480 | A * | 7/2000 | Baldwin | 52/612 |
| 6,088,987 | A * | 7/2000 | Simmons et al. | 52/592.6 |
| D429,346 | S * | 8/2000 | Martin, Jr. | D25/117 |
| 6,138,426 | A * | 10/2000 | Mork et al. | 52/562 |
| 6,145,267 | A * | 11/2000 | Pardo | 52/606 |
| 6,189,282 | B1 * | 2/2001 | VanderWerf | 52/582.1 |
| 6,240,693 | B1 * | 6/2001 | Komasara et al. | 52/439 |
| 6,279,285 | B1 * | 8/2001 | Kubica | 52/426 |
| 6,321,497 | B1 * | 11/2001 | Cormier | 52/425 |
| 6,349,520 | B2 * | 2/2002 | Kubica | 52/426 |
| 6,397,549 | B1 * | 6/2002 | Baldwin | 52/596 |
| 6,397,555 | B1 * | 6/2002 | Pardo | 52/745.1 |
| 6,438,917 | B2 * | 8/2002 | Kubica | 52/426 |
| 6,691,485 | B1 * | 2/2004 | Prokofyev | 52/604 |
| 6,851,235 | B2 * | 2/2005 | Baldwin | 52/309.17 |
| 6,993,878 | B2 * | 2/2006 | Prokofyev | 52/604 |
| 7,007,436 | B1 * | 3/2006 | Kelley | 52/605 |
| 7,406,804 | B2 * | 8/2008 | Den Daas | 52/285.3 |
| 7,665,269 | B2 * | 2/2010 | Azar | 52/592.1 |
| 7,762,033 | B2 * | 7/2010 | Scott et al. | 52/425 |
| 7,818,938 | B2 * | 10/2010 | Lemieux | 52/564 |
| 7,905,070 | B2 * | 3/2011 | August | 52/604 |
| 7,971,407 | B2 * | 7/2011 | MacDonald | 52/568 |
| 8,074,419 | B1 * | 12/2011 | Humphress et al. | 52/607 |
| 8,122,657 | B2 * | 2/2012 | Stein | 52/233 |
| 8,133,337 | B2 * | 3/2012 | Dardanis et al. | 156/71 |
| 8,171,693 | B2 * | 5/2012 | Banova | 52/592.5 |
| 8,549,811 | B2 * | 10/2013 | Dyson | 52/604 |
| 8,707,652 | B2 * | 4/2014 | Kim et al. | 52/605 |
| 2002/0112427 | A1 * | 8/2002 | Baldwin | 52/309.4 |
| 2003/0079432 | A1 * | 5/2003 | Azar | 52/604 |
| 2005/0081470 | A1 * | 4/2005 | Utsunomiya | 52/596 |
| 2005/0108972 | A1 * | 5/2005 | Banova | 52/596 |
| 2006/0037271 | A1 * | 2/2006 | Sinclair | 52/596 |
| 2006/0059839 | A1 * | 3/2006 | Azar | 52/606 |
| 2007/0017176 | A1 * | 1/2007 | Gray | 52/605 |
| 2007/0119115 | A1 * | 5/2007 | Negron Crespo | 52/596 |
| 2007/0193165 | A1 * | 8/2007 | Stokes | 52/404.1 |
| 2007/0245660 | A1 * | 10/2007 | Scott et al. | 52/438 |
| 2007/0277472 | A1 | 12/2007 | Sinclair | |
| 2008/0028710 | A1 * | 2/2008 | Alexander | 52/444 |
| 2008/0066408 | A1 * | 3/2008 | Hileman et al. | 52/414 |
| 2008/0104912 | A1 * | 5/2008 | Au et al. | 52/309.8 |
| 2008/0148676 | A1 * | 6/2008 | Azar | 52/604 |
| 2009/0113835 | A1 * | 5/2009 | Banova | 52/604 |
| 2009/0151292 | A1 * | 6/2009 | Sinclair, Sr. | 52/596 |
| 2010/0043336 | A1 * | 2/2010 | Jensen | 52/604 |
| 2010/0064623 | A1 * | 3/2010 | Sinclair | 52/596 |
| 2010/0095628 | A1 * | 4/2010 | Belsley | 52/562 |
| 2010/0236177 | A1 * | 9/2010 | Roberts et al. | 52/404.1 |
| 2011/0146191 | A1 * | 6/2011 | Farrell | 52/604 |
| 2012/0060438 | A1 * | 3/2012 | Jensen | 52/438 |
| 2013/0081353 | A1 * | 4/2013 | Jensen | 52/742.1 |
| 2014/0150361 | A1 * | 6/2014 | Castonguay et al. | 52/309.4 |

* cited by examiner

WALL BUILDING SYSTEM AND METHOD

BACKGROUND OF THE INVENTION

1. Field of the Invention

The present invention generally relates to building construction, and particularly to a wall building system and method that includes a block for building walls and other structures without the use of mortar or other binding adhesives.

2. Description of the Related Art

Most building blocks used for wall construction and the like are made of brick, concrete, terra cotta, etc. and employ an adhesive, such as mortar, to bind the blocks together to form the wall structure. The applied architectural techniques utilized in this form of construction are labor-intensive, require extensive planning, and are relatively expensive. Recently, prefabricated building blocks made of composite materials have been utilized in an effort to minimize both labor and material costs. The construction industry would certainly welcome an improved composite building block having a specifically designed profile that would enhance building techniques, lower expenses and permit easily assembled wall prototypes. This also allows, for the first time, the opportunity to prototype a full house in a showroom, for example. Thus, a wall building system and method solving the aforementioned problems is desired.

SUMMARY OF THE INVENTION

The wall building system is based upon a block for building walls and other structures. Although composite material is preferred, the block may be fabricated from a single material, if suitable. The block is formed with an external face member and an internal face member connected by an inner core, which has an outer surface formed with a concave profile. The block is fabricated in one piece to enhance strength and stability. Each face is provided with a continuous groove therearound. The continuous grooves are adapted to receive locking elements therein to interlock the blocks. Utilizing a locking element eliminates the need for binding compounds, such as mortar, thereby greatly reducing labor and material costs. This arrangement allows a prototype wall up to three stories high to be built without the need for any additional supporting structure. When the blocks are assembled, the configuration of the inner core will define channels and passages between the respective blocks to receive electrical wiring, plumbing conduits, and other utility items therethrough. The block is fabricated from materials that have good insulating qualities, thereby allowing the block to be effectively employed in hot, cold, and humid environments. The internal profile of the blocks is compatible for wooden, steel, or concrete skeletal structure.

Accordingly, the invention presents prefabricated construction blocks that are easy to assemble and allow the use of a dry-build method, thereby eliminating the need for adhesive binders. The blocks are sturdy and comply with international building codes. The blocks can be designed and fabricated in various shapes and sizes such that different architectural styles can be effectively accommodated. Alternative surfaces, such as wood, steel, or leather, could be applied. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
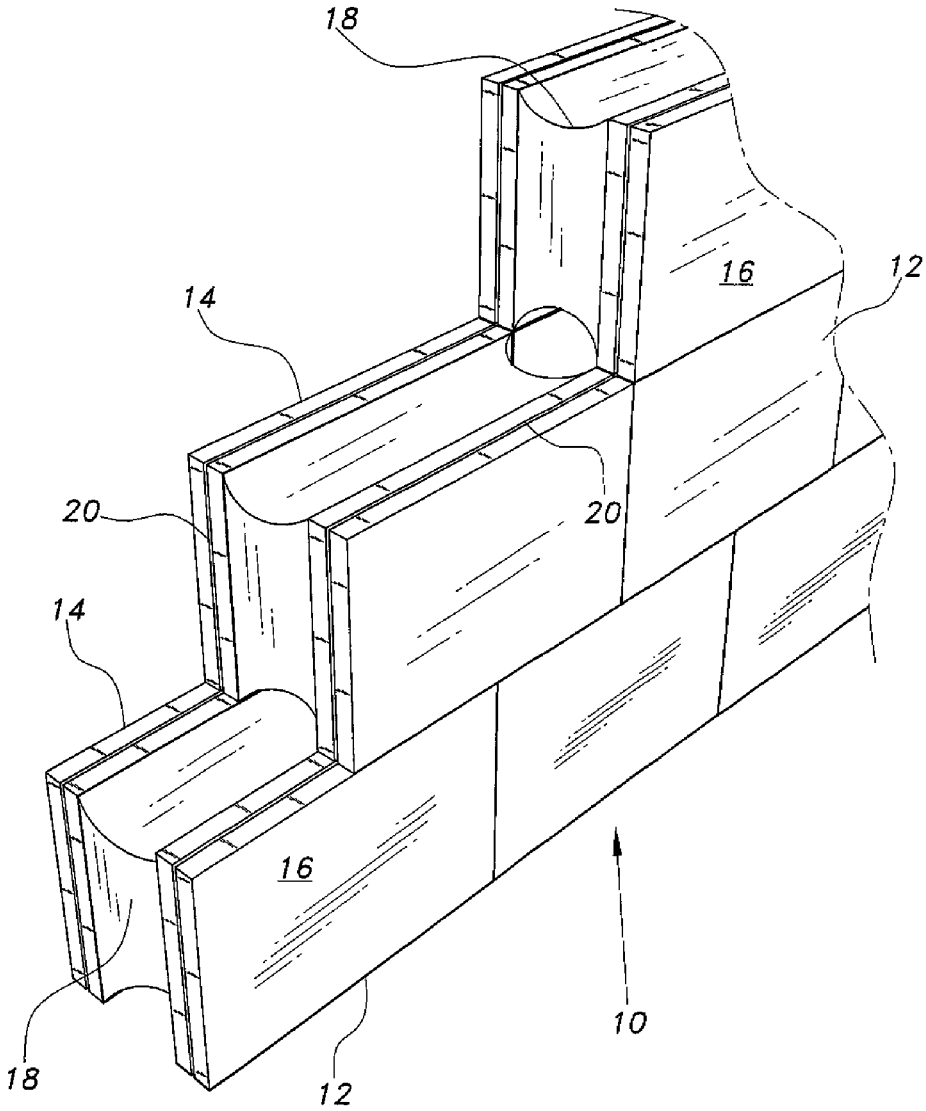
FIG. 1 is an environmental, perspective view of a portion of a wall constructed in accordance with a wall building system and method according to the present invention.
Figure 2:
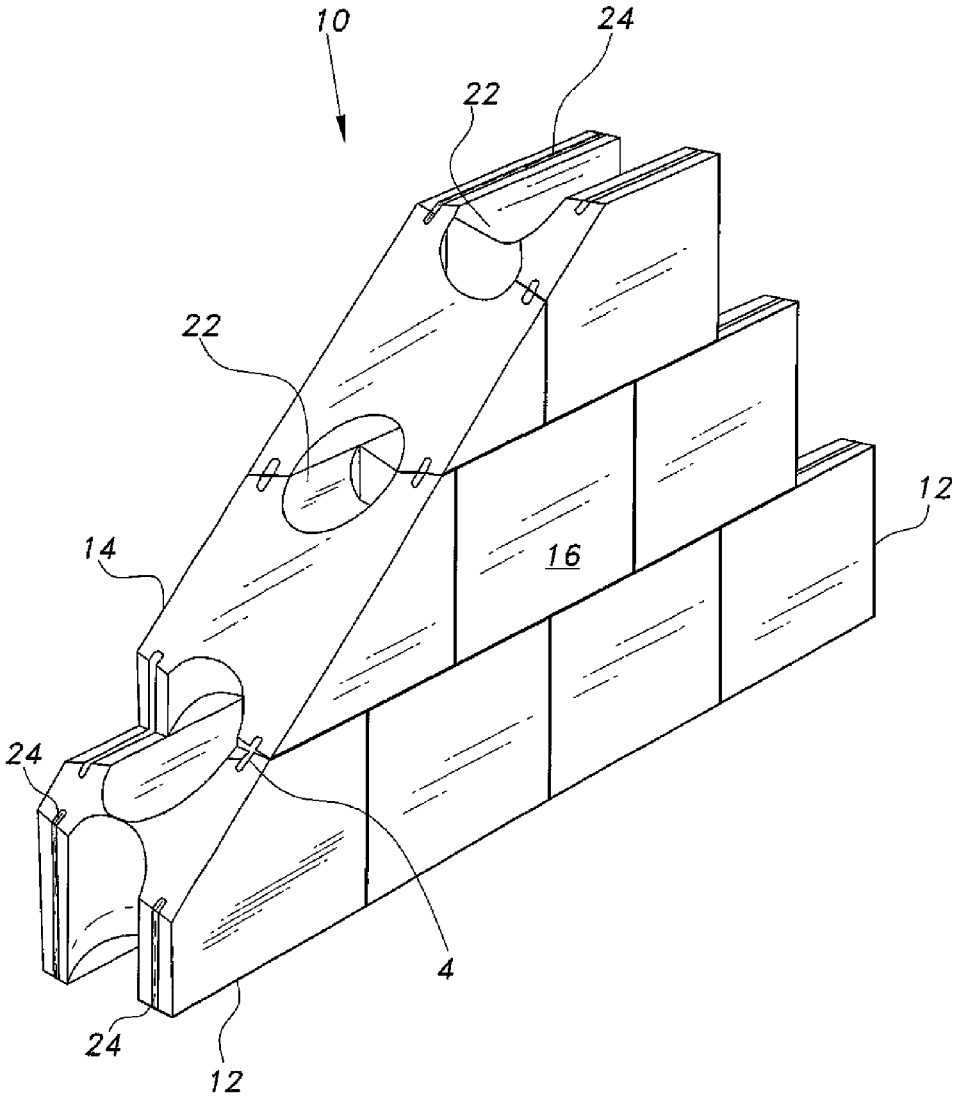
FIG. 2 is a perspective view of a partial wall constructed in accordance with a wall building system and method according to the present invention, shown partially in section to show details thereof.
Figure 3:
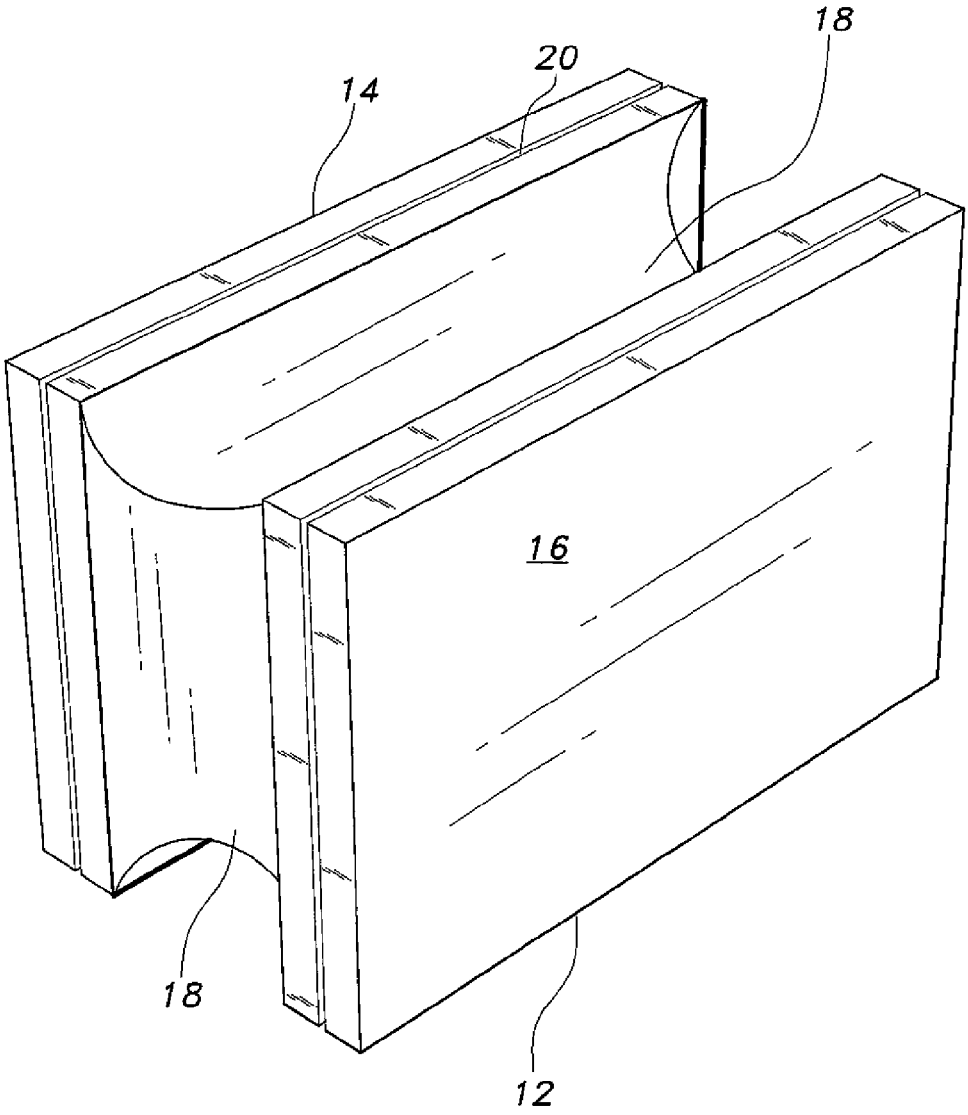
FIG. 3 is a perspective view of a rectangular building block in a wall building system and method according to the present invention.

Referring to FIGS. 1-3, the wall building system is generally indicated at 10. Walls in the system 10 comprise a series of prefabricated block elements 12 that are assembled layer by layer to form the wall. Each block element 12 comprises an inner face member 14 and an outer face member 16 that are connected via a profiled core member 18. Each face member 14, 16 is provided with a continuous groove 20 around the face. The core member 18 is designed in a concave profile so that channels or passages 22 are formed in the wall when the blocks 12 are assembled. The core 18 is fabricated from materials having good insulation qualities. As indicated above, the passages 22 permit the insertion of electrical wiring, plumbing conduits and the like during the assembly process. The exposed surfaces of each face member 14, 16 can be plastered and painted before assembly. Connecting elements 24, preferably fabricated from steel, are inserted in the grooves 20 and interwoven between respective blocks 12 to lock the blocks 12 together.

Figure 4:
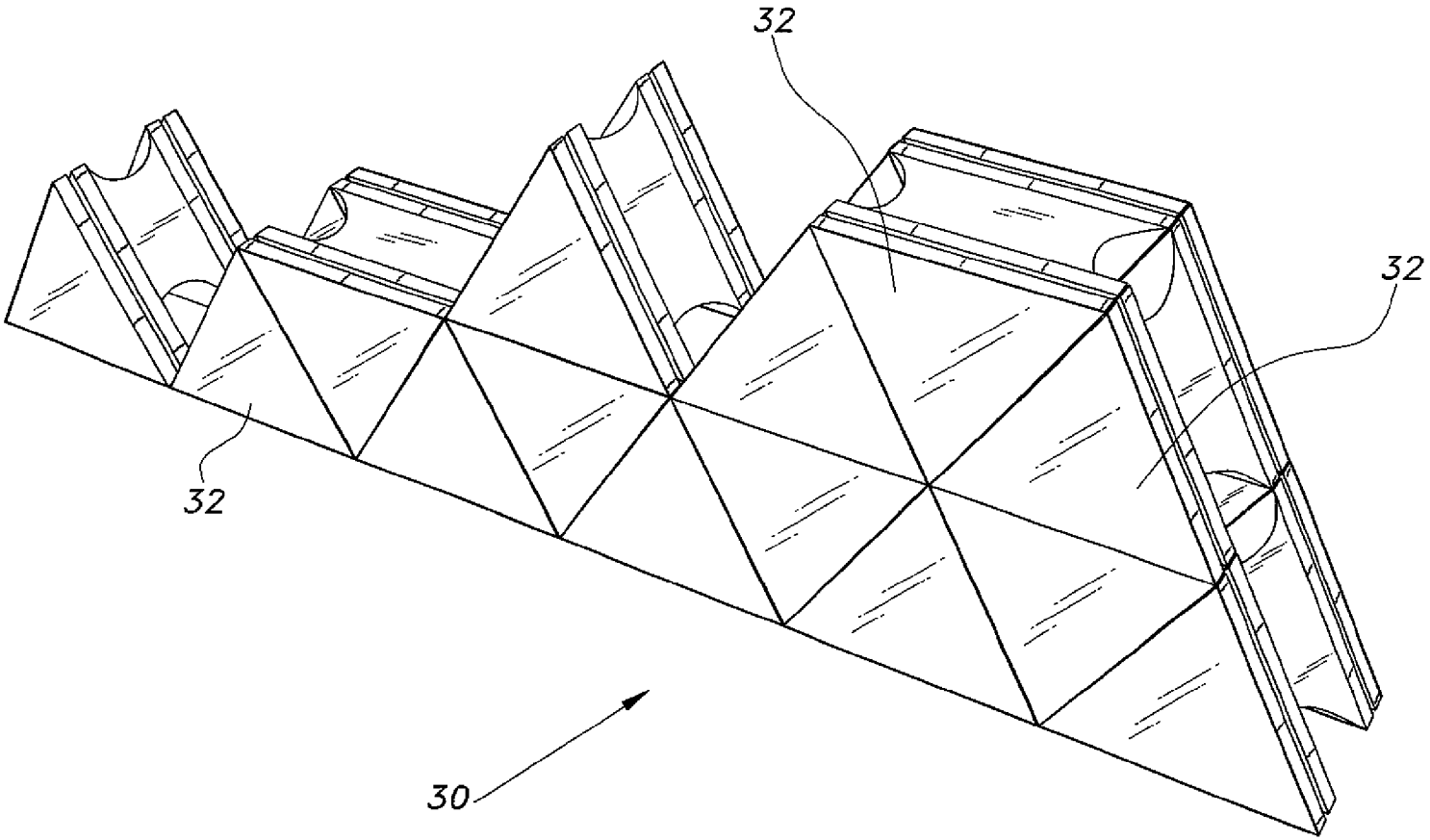
FIG. 4 is a perspective view of a partial wall constructed with triangular-shaped building blocks in accordance with a wall building system and method according to the present invention.
Figure 5:
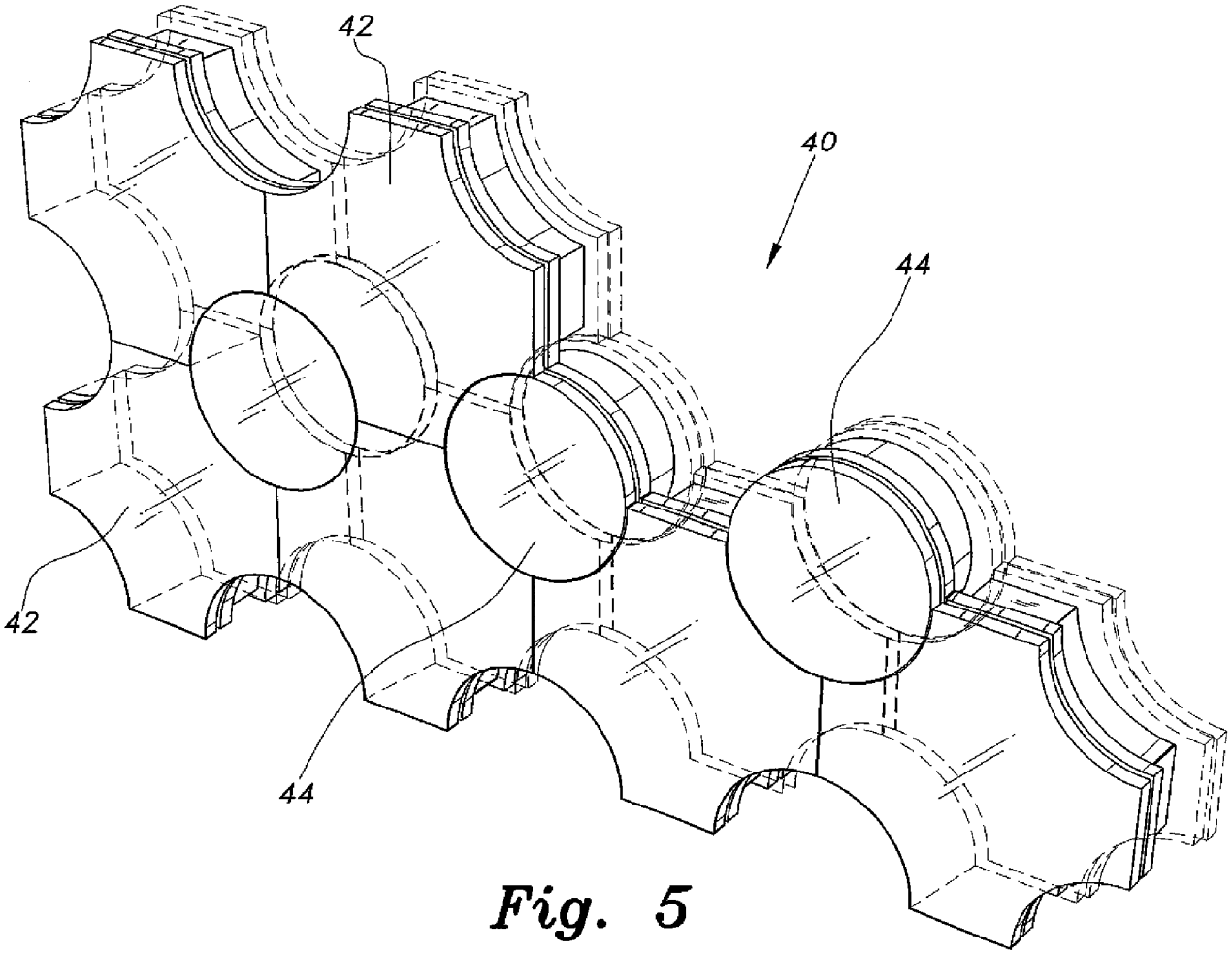
FIG. 5 is a perspective view of a partial wall constructed with curved and circular building blocks in accordance with a wall building system and method according to the present invention.
Figure 6:
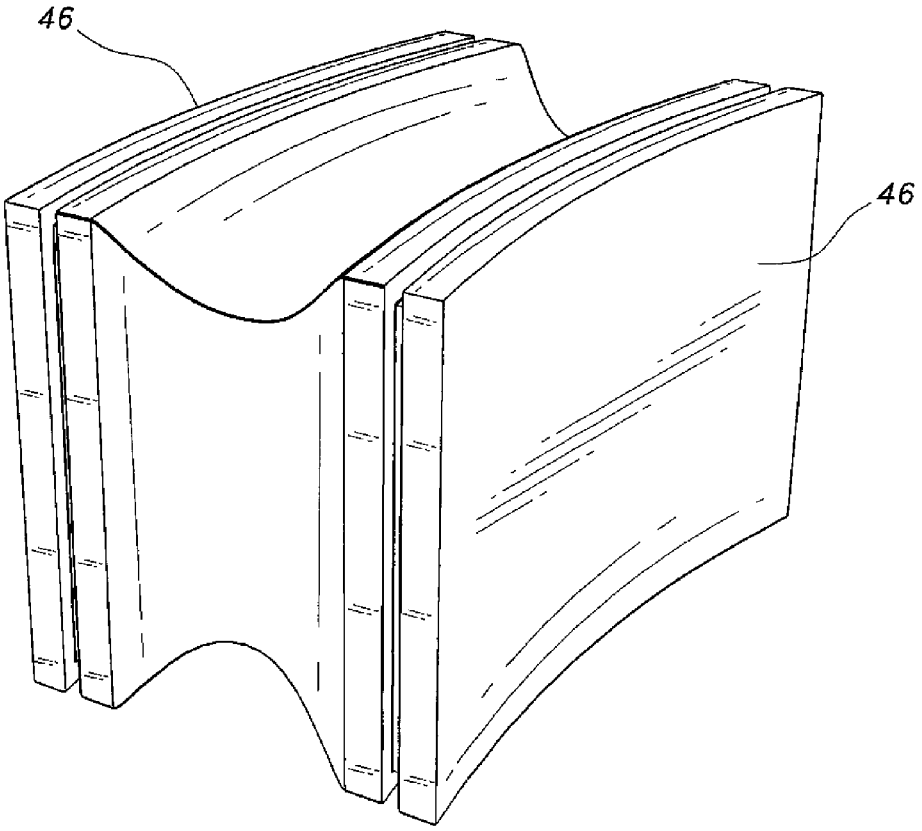
FIG. 6 is a perspective view of a building block having concave faces in a wall building system and method according to the present invention.
Figure 7:
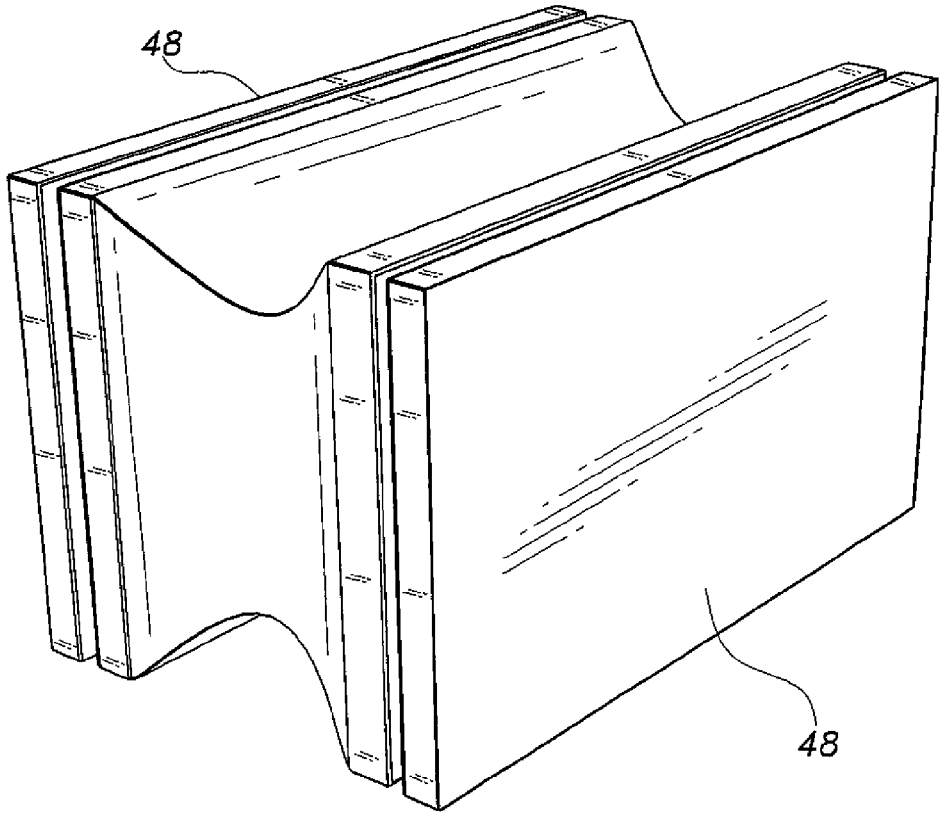
FIG. 7 is a perspective view of a building block having convex faces in a building system and method according to the present invention.

As mentioned above, the blocks 12 may be fabricated in various shapes and sizes. Examples of such variety are illustrated in FIGS. 4 and 5. FIG. 4 shows a wall 30 made from an assembly of triangular blocks 32. FIG. 5 shows a wall 40 made from an assembly of respective curved and circular blocks 42, 44. FIG. 6 shows a block having concave faces, and FIG. 7 shows a block having convex faces, respectively. It is emphasized that the blocks are not limited to the configurations shown and discussed above. The blocks can be designed in almost any geometrical shape (hexagonal, octagonal, etc.) to accommodate different architectural styles and aesthetic tastes.

It is to be understood that the present invention is not limited to the embodiments described above, but encompasses any and all embodiments within the scope of the following claims.

We claim:

1. A block for use in a building erection, consisting of:

an inner face member formed of a composite material of predetermined thickness, and defining a perimeter there around, the perimeter having a groove disposed continuously within the thickness of the perimeter;

an outer face member formed of a composite material of predetermined thickness, and defining a perimeter there around, the perimeter having a groove disposed continuously within the thickness of the perimeter;

wherein the inner face member and the outer face member being disposed in a substantially parallel manner, and being spaced apart by a span of predefined distance;

a core member formed of insulative composite material and disposed in the span between the inner face member and the outer face member and being coextensive therewith; the core member having a smooth concave profile along a perimeter thereof connecting the inner face member to the outer face member defining a continuous arcuate surface from the inner face member to the outer face member; and locking members being fabricated from steel disposed in the grooves of each of the inner face member and the outer face member;

wherein the concave profile of the core member of the plurality of blocks defines passages through the building erection for electrical conduits, plumbing conduits, heating and air conditioning conduits.

2. A wall building system, consisting of:

a plurality of building blocks, each of the blocks being fabricated from a composite material and having:

an inner face member, wherein the inner face member includes a first surface, an opposite second surface and a peripheral edge surface;

an outer face member, wherein the outer face member includes a first surface, an opposite second surface and a peripheral edge surface; and a core member, the core member being made from insulative material;

wherein the inner face member being spaced from and parallel to the outer face member, each of the inner and outer face members having a respective groove defined within the peripheral edge surface, each of the grooves being continuous around the entire peripheral edge surface; and the core member spanning the space between and connecting the opposite second surface of the inner face member to the opposite second surface of the outer face member, wherein the core member is coextensive with the opposite second surfaces of the inner and outer face members, the core member having a perimeter, and a concave profile along the perimeter of the core member, defining a continuous arcuate surface from the opposite second surface of the inner face member to the opposite second surface of the outer face member; and a plurality of locking members, the plurality of locking members cooperatively engaging the grooves of each of the inner face member and the outer face member for securing each one of the plurality of blocks to an adjacent one of the plurality of blocks.

* * * * *